United States Patent [19]

Jacobs et al.

[11] Patent Number: 4,987,026

[45] Date of Patent: Jan. 22, 1991

[54] FLAME RETARDANT FABRIC STRUCTURE

[75] Inventors: Martin I. Jacobs, Granger; Fredric L. Schrock, Mishawaka, both of Ind.; David P. Derse, Elm Grove, Wis.

[73] Assignee: Uniroyal Plastics Co., Inc., Mishawaka, Ind.

[21] Appl. No.: 239,150

[22] Filed: Aug. 31, 1988

[51] Int. Cl.[5] ..... B32B 7/00

[52] U.S. Cl. ..... 428/246; 428/253; 428/254; 428/257; 428/258; 428/259; 428/262; 428/268; 428/290; 428/423.1; 428/920

[58] Field of Search ..... 428/246, 253, 254, 257, 428/258, 259, 262, 268, 290, 373, 920, 413.1

[56] References Cited

U.S. PATENT DOCUMENTS

| | | | |
|---|---|---|---|
| 2,650,184 | 8/1953 | Biefield | 154/128 |
| 2,956,917 | 3/1956 | Fasano | 154/128 |
| 3,366,001 | 1/1968 | Meserole | 87/6 |
| 3,439,491 | 4/1969 | Scruggs | 57/160 |
| 3,490,985 | 1/1970 | Marzocchi et al. | 161/93 |
| 3,572,397 | 3/1971 | Austin | 139/426 |
| 3,666,522 | 3/1970 | George | 117/33 |
| 3,668,041 | 6/1972 | Lonning | 156/309 |
| 3,709,721 | 1/1973 | King | 117/104 R |
| 3,723,139 | 3/1973 | Larkin | 260/45.75 R |
| 3,729,920 | 5/1973 | Sayers et al. | 57/144 |
| 3,886,015 | 5/1975 | Turner | 156/166 |
| 3,913,309 | 10/1975 | Chiarotto | 57/144 |
| 3,968,284 | 7/1976 | George | 428/90 |
| 3,968,297 | 7/1976 | Sauer | 428/268 |
| 4,024,700 | 5/1977 | Drummond | 57/144 |
| 4,081,579 | 3/1978 | Queen et al. | 428/95 |
| 4,282,283 | 8/1981 | George et al. | 428/288 |
| 4,299,884 | 11/1981 | Payen | 57/229 |
| 4,331,729 | 5/1982 | Weber | 428/252 |
| 4,381,639 | 5/1983 | Kress | 57/229 |
| 4,464,502 | 8/1974 | Jacobs | 524/411 |
| 4,500,593 | 2/1985 | Weber | 428/257 |
| 4,502,364 | 3/1985 | Zucker et al. | 87/8 |
| 4,526,830 | 7/1985 | Ferziger et al. | 428/268 |
| 4,541,231 | 9/1985 | Graham, Jr. et al. | 57/12 |
| 4,670,327 | 6/1987 | Weber | 428/257 |
| 4,690,859 | 9/1987 | Porter et al. | 428/273 |
| 4,746,565 | 5/1988 | Bajford et al. | 428/268 |
| 4,764,412 | 8/1988 | Barns et al. | 428/254 |
| 4,806,185 | 2/1989 | Porter et al. | 156/78 |
| 4,868,041 | 9/1989 | Yamagishi et al. | 428/254 |

FOREIGN PATENT DOCUMENTS

| | | |
|---|---|---|
| 51-060767 | 7/1976 | Japan . |
| 57-174335 | 10/1982 | Japan . |
| 58-1106 | 3/1983 | Japan . |
| 58-215858 | 6/1985 | Japan . |
| 61-261330 | 11/1986 | Japan . |
| 876746 | 5/1961 | United Kingdom . |
| 1593048 | 8/1976 | United Kingdom . |

OTHER PUBLICATIONS

Boston Fire Department Chair Test, 1986.

State of California Flammability Information Package, 1987.

*Primary Examiner*—James J. Bell

*Attorney, Agent, or Firm*—Pennie & Edmonds

[57] ABSTRACT

A flame-retardant coated fabric article of a single layer of fabric containing glass fibers and natural or synthetic fibers one side of which is covered by a thermoplastic polyvinyl halide composition to impart the desired diapability, hand, and tailorability properties to the article. The glass fibers provide strength to the article so that, when the article placed under tension forces and exposed to fire or a flame, it does not tear apart due to the tension forces as the coating burns, thus providing a barrier to the penetration of flame through the article. The coating also is capable of forming a char which contributes to the effectiveness of the flame barrier.

25 Claims, No Drawings

FLAME RETARDANT FABRIC STRUCTURE

TECHNICAL FIELD

The invention relates to a flame retardant fabric structure including a PVC coated fabric which contains both glass and natural or synthetic fibers for use as a covering on foam cushions, especially polyurethane foam. Such coated fabric foam articles can be used to form cushions, chairs, sofas and seats for automobiles, trains, buses and the like.

BACKGROUND ART

There has been concern for a long time regarding the fabric materials utilized to coat chairs, beds and other articles which contain polyurethane foam cushioning from the standpoint of the flame retardancy or fire resistance of the overall construction. The polyurethane foam produced for use in such materials can be made flame retardant, but this generally requires the use of very expensive additives which also are harmful to form aesthetic properties (e.g. CMHR foam). Neoprene foams also can be used for flame retardancy, but they are very expensive and dense. A chart listing the approximate density and cost for different types of foams appears below.

| Material | Density (lbs./cu.ft.) | Cost (¢/bd.ft.) |
|---|---|---|
| Non-flame retardant foam | 1 to 2.5 | 12–15 |
| California HR-117* foam | 1.5 to 3 | 19–25 |
| Melamine Modified Foam (MPU) | 3–4 | 57–62 |
| Combustion Modified HR Foam (CMHR) | 4–5 | 70–80 |
| Neoprene Foam | 6–8 | 90–95 |

*High Resiliency Foam in conformance with State of California Technical Bulletin 117 entitled "Requirements, Test Procedure and Apparatus for Testing the Flame Retardance of Resilient Filling Materials used in Upholstered Furniture."

These foams generally reflect different levels of flame retardance, with the Neoprene foam providing the highest level of flame retardance, followed by the CMHR, MPU and HR-117 foams. The relative flame retardance of the foam is directly proportional to its cost, but the physical properties of the foam, particularly the compression set, tensile strength and toughness properties, are generally inversely proportional to the flame retardance levels of the foam. Thus, furniture manufacturers prefer to utilize the HR-117 and MPU foams due to their low cost and improved physical properties. The flame retardancy of the latter materials, however, is insufficient to pass certain stringent fire codes and standards.

Despite their utility as flame retardant materials, each of these foams will burn in the presence of a flame, the extent of the burning being directly dependent upon the duration and amount of heat to which the foam is exposed from fire or a flame. Accordingly, it is generally accepted in the industry to protect the foam from such exposure to flame by the use of a material which acts as a barrier to the flame, especially when protection against intense flame exposure is desired.

The types of barriers which have been used according to the prior art include flame-retardant fabrics, batting or foams. Many of these are effective in protecting foams used in cushions from exposure to flame. However, they result in additional steps in the furniture manufacturing process, adding cost. They also often reduce product aesthetics. As discussed below, the current invention overcomes both of these disadvantages.

Another problem which must be addressed is the fact that many coated fabrics and foams, when tested individually, provide flame retardance properties which are acceptable by many standards. When combined in a chair or similar article, however, the combination of such materials provides insufficient flame retardance. Furthermore, many regulations set relatively low standards which almost any type of flame retardant material can pass. This may lead certain manufacturers to use lesser cost foams which, as noted above, possess a lesser degree of flame retardancy. The same is true for the use of lesser cost coated fabrics.

The challenge, therefore, is to develop a coated fabric for use on a foam, cushion or support to achieve a combination which is capable of self-extinguishing after a flame is removed without burning excessively, exposing the foam to the flame, or generating large quantities of smoke or other toxic gases.

Generally, coated fabrics include a layered structure usually of four or five layers. A top coat, usually less than 1 mil thickness, is used for abrasive resistance and surface wear. This tough layer can be formulated of a PVC/acrylic, urethane or other acrylic composition, and it also imparts a luster or gloss finish to the article. Next, a PVC skin coat of about 5 to 10 mils is used for color and snag resistance. If needed, a color correction layer can be applied between the top and skin coats. Beneath the skin coat is often a PVC foam layer of between about 15 and 40 mils. A PVC adhesive can be used to ensure good bonding between the coating and the fabric backing, which normally is a natural or synthetic fiber or combinations thereof in a knit, woven, or other configuration. The particular fabric construction is selected based on the end use of the coated fabric, with consideration given to the requirements of hand, tailorability, drapability, etc.

Such coated fabrics have been on the market for a long time due to the relative ease of combining these materials into a composite structure. As noted above, however, the PVC layers will burn in the presence of a flame. Should enough heat and flame be encountered to burn a significant portion of the PVC material, the fabric will open and allow the fire to attack the foam. Even when the highest flame retardancy foam formulations are used, flame in contact with the foam can cause burning which generates large quantities of smoke and other toxic gases. In addition, use of such highly flame retardant foam incurs a much greater cost for the construction of the chair or other article, while also producing less comfortable seating. Thus, it is important to achieve a construction wherein the foam does not become exposed to the flame due to opening of the fabric when the coating burns.

It is well known that fiberglass fabric does not burn, hence, a wide variety of single strand, mat, and woven fiberglass fabrics have been used as backings for PVC coatings. Various combinations of knit and woven fiberglass fabrics have been utilized in an attempt to develop a fabric backing which will not open up and expose the foam to flame. In addition to high costs, these materials are deficient with respect to the aesthetics of the coated fabric, i.e., the "feel" of the fabric as well as other features such as flexibility, sewability, tailorability, drapability, manufacturability and the like. Accordingly, there is a great need in the trade for a coated fabric product which possesses the desired flame retardant capabilities as well as aesthetic properties for use on chairs, couches, automobile seats and the like. The present invention provides one such construction, as will be explained in detail hereinbelow.

SUMMARY OF THE INVENTION

The invention relates to a coated fabric article comprising a single layer of fabric containing between about 10 and 90 weight percent of glass fiber and between 90 and 10 weight percent of a natural or synthetic fiber other than glass, and a coating substantially completely covering one side of the fabric. The fabric has a weight of between about 1.5 and 5.5 ounces per square yard; while the coating comprises a fire-retardant thermoplastic polyvinyl halide composition in a thickness of between about 10 and 60 mils to impart the desired drapability, tailorability and physical properties to the coated fabric. When the coated fabric is placed under tension forces and exposed to fire, the glass fiber provides a structure which provides strength to said article so that it does not tear apart due to the tension forces when the coating burns, thus providing a barrier to the penetration of flame through the article. Also, as the coating burns, it forms a char which adheres to the fabric and is believed to contribute to the effectiveness of the flame barrier.

Preferably, the glass fibers are woven in both directions, and constitute between 30 and 50 weight percent of the fabric. Also the fibers can be spun into a yarn and then made into a knit construction. Preferably, the glass fibers advantageously form the core of the yarn and wherein the natural or synthetic fibers form a fiber sheath around the core, with the fiber sheath comprising cotton or polyester fibers present in an amount of about 50 to 70 weight percent of the yarn.

The polyvinyl halide composition generally comprises a polyvinyl halide and a plasticizer. Optionally, a flame retardant agent may be used such that the plasticizer is present in an amount of between about 30 and 120 parts and the flame retardant agent is present in an amount of between about 1 and 50 parts, each of said parts being based upon 100 parts polyvinyl halide in the composition. Also, an additive to reduce smoke generation when said composition is burned may be included in an amount of between about 1 and 30 parts, and a filler can be added in an amount of between about 1 and 60 parts.

The coating generally comprises multiple layers, e.g. an outer layer of a tough, abrasion and wear resistant top coat, a skin layer beneath the top coat for providing snag resistance and color to the coated fabric article, a foam layer beneath the skin layer to impart the desired "feel" to the article, and an adhesive layer for adhering the coating to the fabric.

The invention also relates to a flame retardant article of a flame retardant polyurethane foam which is covered by the coated fabric article described above. The foam may be melamine modified polyurethane foam, or a high resilency or conventional polyurethane foam in conformance with the requirements of the State of California Technical Bulletin 117. Thus, when the foam article is made into a seat cushion and subjected to the City of Boston Full Scale Chain Burn Test IX-2, the article will exhibit a flame out time of less than 8 minutes and weight loss of less than 10% with no dripping of foam, no excessive generation of smoke, and substantially no flame penetration through the article.

DETAILED DESCRIPTION OF THE INVENTION

Throughout this application, the different classes of polyurethane foam with regard to flame retardancy will be identified as set forth below:

| Foam Material | Foam Designation | Relative Flame Retardance* |
|---|---|---|
| Neoprene | NP | 1 |
| Combustion Modified High Resiliency | CMHR | 2 |
| Melamine Modified Polyurethane | MPU | 3 |
| California-117 High Resiliency | HR-117 | 4 |

*Scale of 1–4 with 1 being best

Similarly, the use of coated fabrics will also be designated by class, as follows:

| | Material | Designation |
|---|---|---|
| 1) | Conventional Flame-retardant Vinyl on Synthetic Fabric | STD |
| 2) | Low-Smoke Vinyl on Synthetic Fabric | LS |
| 3) | Low Smoke Vinyl on Combination Glass/Synthetic Fabric | PLUS |
| 4) | Low Smoke Vinyl on 100% Glass Fabric | LSG |
| 5) | Non Flame-Retardant Vinyl on Combination Glass/Synthetic Fabric | NFG |
| 6) | Low Smoke Vinyl on Fabric Having Glass Fiber in One Direction, Synthetic Fiber in the Other Direction. | MPF |
| 7) | Non-Flame-Retardant Vinyl Vinyl on Fabric Having Glass Fiber in one Direction, Synthetic Fiber in the Other Direction. | NFF |

Typical examples of commercial articles of such materials are as follows:

| Material | Manufacturer | Designation |
|---|---|---|
| NP foam | Uniroyal Plastics | Koylon ® SLS |
| CMHR foam | NCFI | CMHR |
| MPU foam | Hickory Springs | Code Red ® |
| HR-117 foam | Hickory Springs | HR - 30C |
| STD fabric | Uniroyal Plastics | Naugahyde ® Spirit ® and Naugahyde ® Neochrome ® |
| LS fabric | Gencorp | USA |
| | Uniroyal Plastics | Naugahyde ® Innovation ® |
| PLUS fabric | Uniroyal Plastics | Naugahyde ® Flame Block 2-200 ® |

A preferred PVC formulation for use in the coated fabrics of the invention is disclosed in U.S. Pat. No. 4,464,502, the content of which is expressly incorporated herein by reference thereto. These PVC formulations generally include a fire retardant agent such as antimony trioxide, a plasticizer of a high boiling ester, and zinc oxide as an additive to reduce smoke generation. The relative amounts of each of these components, based on 100 parts by weight of the PVC resin, is as follows: flame retardant agent 1 to 50 parts, smoke reducing additive 1 to 30 parts, and plasticizer 30 to 120 parts. Such compositions also typically include UV/-heat stabilizers, various fillers, and, when foamed compositions are desired, a blowing agent.

Although not preferred, is is possible to use PVC resin alone, or solely with a flame retardant additive such as antimony trioxide, and still achieve the improved results of the invention. It is also possible to use fluorinated compounds as the coating material, depending upon the desired results. Thus, the term polyvinyl halide is used to describe the compounds which are suitable acording to the invention, as will be discussed in more detail below. At present, however, the low smoke flexible PVC formulations according to U.S. Pat. No. No. 4,464,502 are most preferred.

A wide variety of coating structures are also suitable in the present invention. This includes the use of single or multiple layers of the PVC composition whether applied by spray, calendering, coating, extrusion or the like. An especially preferred coating construction is a three layer PVC laminate which is directly applied to the fabric by a three head coater, a machine which is well known to those skilled in the art. To describe this coating, we will consider the outermost layer first down to the layer which contacts the fabric, which will be referred to as the bottom.

The top layer is a layer of between about 5 to 10 mils of plasticized PVC, and is referred to as a skin coat. This layer is utilized to impart snag resistance to the article as well as to impart the desired color. Beneath this skin coat is another layer of PVC which includes a blowing agent to expand this layer from its initial 5 to 10 mils thickness to a 15 to 40 mil foam. The foam imparts the desired "feel" to the fabric and generally is used to provide softness to the overall construction. The preceding layers are then adhered to the fabric by a PVC adhesive which ranges in thickness from about 2 to 7 mils.

The material is then taken from the coater to a printing operation, where one or more layers are added to the top. When the color of the skin coat is not proper, a very thin color correction coat can be placed between the skin coat and the top coat. However, the color correction coat is generally not necessary and may be considered optional. One or more decorative layers may also be added by using a pattern print. A top coat of less than one mil thickness can be applied as a tough and abrasion resistant surface wear layer. This top coat imparts the desired luster or gloss to the coating and can be made from PVC/acrylic, or, for particular applications, a urethane, other acrylic, or alternate material. This top coat is added last at the end of the printing stage.

While the preceding construction has been found to be particularly advantageous, it is recognized that there are numerous variations and alternate constructions which would provide similar performance in accordance with the teachings of this invention.

When 100% fiberglass fabrics were used according to the prior art, it was found that a highly effective flame retardant fabric would be achieved. Two deficiencies were noted, however, in that the adhesive had to be specially formulated for compatibility with the glass fibers, and the drapability or hand of the material left something to be desired. In addition, it was difficult to stretch woven fiberglass fabrics to fit the desire shape and contour of the cushion, chair, etc. which was to be made. The present invention overcomes these problems by providing a single layer fabric which contains glass fibers as well as natural or synthetic fibers other than glass. Generally, between 10 and 90 weight percent of the glass fibers and between 90 and 10 weight percent of the natural or synthetic fibers are used so that the flame retardant properties of the glass may be combined with the coating adhesion, drapability, hand, and tailoring properties of the natural or synthetic fibers. Furthermore, a wide variety of fabric constructions can be used in the present invention.

For some applications, a mixture of glass and natural or synthetic fibers in mat form may be sufficient, however, it is preferred to use woven or knit blends of the various fibers. When standard weaving or knitting patterns are used, it is possible to select glass fibers for use in one direction of the weave or knit, while the synthetic or natural fibers are used in the opposite directions. A more preferred arrangement utilizes both glass and non-glass fibers in each direction. This can be achieved, for example, by alternating strands of the glass and non-glass fibers in the weave or knit. It is possible and most advantageous to blend the glass and non-glass fibers at the yarn level to form a composite yarn or to intimately blend such materials into a staple fiber. Then, the composite yarn or staple fiber could be used in the form of a mat, woven or knit construction.

At present, the best mode of the invention relates to the use of a core spun fiber wherein the glass forms the core of the fiber and the non-glass fibers form a fiber sheath around the core. The most preferred material is known as Product All supplied by Springs Mills, Fort Mill, S.C. This material is available with either a cotton or polyester sheath around the glass core and it can be made into a knit fabric of various weights ranging from about 2½ to 3 ounces per square yard.

This fabric construction is advantageous for a number of reasons:

1. The glass fibers within the knitted fabric structure form a framework which in addition to providing flame retardance to the fabric also provide strength which can retain the shape of the article when the fabric is subjected to a flame;

2. The covering of the glass with a natural or synthetic fiber enables the desired "feel" (i.e. drapability, hand, tailoring etc.) of the overall article to be achieved;

3. The overall cost of this construction is less expensive than for 100% glass fabric, since the approximate glass: non-glass fiber ratio is about 40:60; and 4. The outer sheath of non-glass fibers enables the PVC coating to be easily adhered thereto by the use of conventional PVC adhesives.

The combination of the preferred fabric with flame retardant polyurethane foam provides an article which has highly improved flame retardance compared to conventional constructions. Such articles have the ability to pass both the California Standard 133 and the Boston Fire Department Full Chair Burn Test IX-2. In the past, only the PVC coated fabric/NP foam or PVC coated fabric/CMHR foam were able to pass the Boston Test. Unfortunately, due to the high flame retardance of those foams, their physical properties left much to be desired and they are relatively difficult to make. The present invention resolves those problems, since the new coated fabrics can be used with either the MPU or HR-117 foams to provide an article which easily passes the desired flame retardance specifications, as indicated by the examples.

The mechanism by which the flame retardant features of the invention are achieved are not fully understood. The PVC coating will burn in the presence of a flame and is not a flame retardant barrier by itself. Also, the fabric is not a flame barrier since the natural or synthetic fibers are also capable of burning in the presence of a flame. The present invention has achieved a combination which when exposed to flame causes the PVC coating to burn and form a crust which is tightly adherent to the underlying fabric. Thus, the coating chars and cracks, but does not separate from the fabric. It is this char which seems to form a barrier to the entry of the flame through the fabric and into the foam.

In comparison, when prior art fabrics are subjected to the Boston IX-2 Test, the PVC coating burns to expose the fabric which, if made of natural or synthetic fibers, can also burn. The loss of coating and supporting fabric extremely weakens the article, so that it appears to rip or tear as the fire continues, thus exposing the foam to the fire. The glass fibers of the present invention provide sufficient strength so that the article does not exhibit this tearing or ripping problem when exposed to fire, and the PVC coating chars and remains firmly adhered to the fabric to act as a flame barrier.

This combination represents a substantial improvement over the prior art in that the same previously approved fire retardant foams can be used to form an article having substantially increased flame retardant properties, or the fabrics can be used with less expensive more easily manufacturable foam compositions while still achieving a high degree of fire retardance. The latter alternative provides a high degree of safety to the end user in a construction which is significantly of lower cost to the purchaser.

EXAMPLES

The following examples are provided for the purpose of illustration only and are not intended to limit the scope of the invention in any manner. Unless otherwise noted, all parts are given in these examples refer to parts by weight per hundred parts of PVC. Regarding the flame testing results, the Boston Test refers to the City of Boston Full Scale Chair Burn Test (IX-2) whereas the California 133 Test refers to the test procedures set forth in the State of California Technical Bulletin 133 entitled "Flammability Test Procedure for Seating Furniture for Use in Public Occupancies."

Typical PVC coating formulations are given in Table I below.

EXAMPLE 1

A PLUS PVC coating on a core-spun 60/40 polyester/glass yarn blended jersey knit fabric having a weight of 2.9 oz/sq. yd. covering a HR-117 foam cushion was subjected to the Boston Test.

EXAMPLE 2

The PVC and foam construction of Example 1 was repeated, except that the fabric was a core-spun 60/40 cotton/glass yarn woven fabric having a weight of 2.0 oz/sq. yd.

EXAMPLE 3 (COMPARATIVE)

The PVC and foam construction of Example 1 was repeated, except that the fabric was a 100% glass modified jersey knit having a weight of 3.1 oz/sq. yd.

The results for Examples 1–3 are presented in Table II.

EXAMPLE 4–23

A number of additional cushions were prepared from various coated fabrics and foams and then burned according to the Boston Test. Cushion construction and test results appear in Table III. Examples 10, 12, 16, 17 and 20 are comparative. It should be noted that Examples 19 and 22 passed the Boston Test, while similar materials tested as Examples 11 and 12 failed. This demonstrates the reason for a preference for utilizing glass fibers in both directions in the fabric, since more consistent good performance was obtained with such a construction.

EXAMPLES 24–28

These examples illustrate the performance of the invention (Example 28) compared to 100% glass fabrics when burned according to the Boston Test. Results appear in Table IV. While all constructions passed the test, the feel and seating characteristics of the construction of Example 8 was highly superior to those of Example 24–27.

EXAMPLE 29–40

These illustrate the performance of different coated fabric/foam constructions, with Examples 29–34 and 37–40 being comparative. Of the comparative examples, only Examples 29 and 31 provide borderline test passing values, while the construction of the invention (Examples 35 and 36) easily passes the test. Class A Fabric designates a 100% polyester fabric having a class A flame rating by ASTM E-84 Testing. Boston Fabric designates a 100% polyester fabric capable of passing Boston IX-2 test with MPU cushion. Results are presented in Table V.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

TABLE I

Typical PVC Coating Formulations

| | Conventional Flame Retardant Vinyl | | | Low Smoke Vinyl | | |
|---|---|---|---|---|---|---|
| Component | Skin | Foam | Adhesive | Skin | Foam | Adhesive |
| Polyvinyl chloride | 100 | 100 | 100 | 100 | 100 | 100 |
| Plasticizer | 80 | 70 | 70 | 80 | 70 | 70 |
| Fillers (Incl. Pigment) | 20 | 30 | 10 | 20 | 20 | 20 |
| Antimony Oxide | 10 | 10 | 20 | 10 | 20 | 20 |
| Zinc Oxide | — | — | — | 10 | 20 | 20 |
| Blowing Agent | — | 2 | 2 | — | 1.7 | 1.7 |

TABLE I-continued

| Component | Typical PVC Coating Formulations: Conventional Flame Retardant Vinyl Skin | Foam | Adhesive | Low Smoke Vinyl Skin | Foam | Adhesive |
|---|---|---|---|---|---|---|
| Others (Stabilizers, Fungicides, etc.) | 0.5 | 2 | 2.5 | 0.25 | 2 | 2 |
| | 210.5 | 214.0 | 204.5 | 220.25 | 233.7 | 233.7 |
| Typical Weights In (ounces per square yard) | 10 | 10 | 5 | 10 | 10 | 5 |

TABLE II

| | Boston Test Results: Flame-Out Time (min.) | % Weight Loss |
|---|---|---|
| Example 1 | 3.3 | 6.4 |
| Example 2 | 2.8 | 2.8 |
| Example 3 (Comparative) | did not flame-out | burned completely |

TABLE III

Boston Test Results

| Example | Vinyl/ Fabric | Foam | Flame Out (min) | % Wt. Loss | Max. Temp. °F.* | Smoke level |
|---|---|---|---|---|---|---|
| 4 | PLUS | HR-117 | 3.25 | 5.7 | 175 | Normal |
| 5 | PLUS | HR-117 | 2.42 | 5.8 | 145 | Normal |
| 6 | PLUS | HR-117 | 3.10 | 6.4 | 139 | Normal |
| 7 | PLUS | MPU | 3.00 | 6.6 | 149 | Normal |
| 8 | PLUS | MPU | 3.33 | 4.5 | 140 | Normal |
| 9 | PLUS | MPU | 3.27 | 4.7 | 166 | Normal |
| 10 | STD | HR-117 | - | - - | 203 | Very Heavy |
| 11 | MPF | HR-117 | - | - - | 137 | Very Heavy |
| 12 | MPF | HR-117 | - | - - | 149 | Very Heavy |
| 13 | PLUS | MPU | 3.33 | 5.95 | 166 | Normal |
| 14 | MPF | MPU | 4.33 | 5.59 | 184 | Normal |
| 15 | LSG | MPU | 2.75 | 4.64 | 166 | Normal |
| 16 | NFG | MPU | 7.50 | 11.88 | 181 | Heavy |
| 17 | NFF | MPU | 7.16 | 11.71 | 162 | Heavy |
| 18 | PLUS | HR-117 | 3.25 | 6.39 | 133 | Normal |
| 19 | MPF | HR-117 | 2.75 | 5.08 | 146 | Normal |
| 20 | LSG | HR-117 | - | - - | 160 | Excessive |
| 21 | PLUS | HR-117 | 3.00 | 6.15 | 179 | Normal |
| 22 | MPF | HR-117 | 2.93 | 5.38 | 164 | Normal |
| 23 | PLUS | MPU | 2.25 | 5.97 | 164 | Normal |

*measured 8' above floor over center of chair.
- did not flame out
- - burned completely

TABLE IV

Boston Test Results
Low Smoke Vinyl Formulations

| Example | Glass Fabric Details | Flame Out (min) | % Wt. Loss | Smoke Level | Max. Temp. °F.* |
|---|---|---|---|---|---|
| 24 (Comparison) | Plain Weave, 100% Glass, 3.2 oz/yd | 2.58 | 4.9 | V. Low | 150 |
| 25 (Comparison) | Plain Weave, 100% Glass, 2.4 oz/sq yd | 3.00 | 5.6 | V. Low | 173 |
| 26 (Comparison) | Knit, 100% Glass 1.6 oz/sq yd | 3.08 | 5.2 | V. Low | 169 |
| 27 (Comparison) | Scrim Weave, 1.6 oz/sq yd | 3.08 | 4.8 | V. Low | 150 |
| 28 | Plain Weave, Core-Spun 60 Cot/40 Glass, 2.0 oz/sq yd | 4.00 | 4.7 | V. Low | - - |

*Measured 8' above floor over center of cushion
- - not measured

TABLE V

Boston Test Results

| Example | VINYL OR FABRIC FOAM CONSTRUCTION | Flame Out | % Wt Loss | Smoke Level |
|---|---|---|---|---|
| 29 | STD-CMHR | 7.00 | 8.19 | Normal |
| 30 | STD-MPU | - | - - | Excessive |
| 31 | LS-CHMR | 5.00 | 9.18 | Normal |
| 32 | LS-CMHR | 5.5 | - - (Left to smolder | Normal |
| 33 | LS-MPU | - | - - | Excessive |
| 34 | LS-MPU | - | - - | Excessive |
| 35 | PLUS-MPU | 3.50 | 4.3 | Normal |
| 36 | PLUS-HR117 | 2.93 | 5.8 | Normal |
| 37 | STD-MPU | - | - - | Excessive |
| 38 | STD-HR117 | - | - - | Excessive |
| 39 | CLASS A FABRIC-HR117 | - | - - | Excessive |
| 40 | BOSTON FABRIC-HR117 | - | - - | Excessive |

- did not flame out
- - burned completely

What is claimed is:

1. A coated fabric article comprising:

a single layer of fabric containing between about 10 and 90 weight percent of glass fiber and between 90 and 10 weight percent of a natural or synthetic fiber other than glass; said fabric having a weight of between about 1.5 and 5.5 ounces per square yard; and a coating substantially completely covering one side of said fabric, said coating comprising a fire-retardant thermoplastic polyvinyl halide composition in a thickness of between about 10 and 60 mils to impart the desired drapability, tailorability and physical properties to the coated fabric; such that, when said coated fabric is placed under tension forces and exposed to fire, said glass fiber provides a structure which provides strength to said article and which does not tear apart due to said tension forces when said coating burns, thus providing a barrier to the penetration of flame through the article.

2. The article of claim 1 wherein the fibers are woven and said coating burns to form a char which adheres to said fabric.

3. The article of claim 1 wherein the glass fibers are woven in a first direction and the natural or synthetic fibers are woven in a second direction.

4. The article of claim 1 wherein the natural or synthetic fibers include cotton, rayon, polyester, wool or nylon.

5. The article of claim 1 wherein the fibers are made into a knit construction.

6. The article of claim 1 wherein the glass fibers constitute between 30 and 50 weight percent of the fabric, and are woven in both directions.

7. The article of claim 1 wherein the fibers are spun into a yarn.

8. The article of claim 7 wherein the glass fibers form the core of the yarn and wherein the natural or synthetic fibers form a fiber sheath around the core.

9. The article of claim 8 wherein the fiber sheath comprises cotton or polyester fibers, and is present in an amount of about 50 to 70 weight percent of the yarn.

10. The article of claim 1 wherein the polyvinyl halide composition comprises a polyvinyl halide and a plasticizer.

11. The article of claim 10 wherein the polyvinyl halide composition further comprises a flame retardant agent, wherein the plasticizer is present in an amount of between about 30 and 120 parts, and the flame retardant agent is present in an amount of between about 1 and 50 parts, each of said parts being based upon 100 parts polyvinyl halide in the composition.

12. The article of claim 11 wherein the polyvinyl halide composition further comprises an additive to reduce smoke generation when said composition is burned.

13. The article of claim 12 wherein the flame retardant agent is present in an amount of between about 1 and 50 parts, the smoke reducing additive is present in an amount of between about 1 and 30 parts, and the plasticizer is present in an amount of between about 30 and 100 aparts, each of said parts being based on 100 parts polyvinyl halide in the composition.

14. The article of claim 13 wherein the polyvinyl composition further comprises a filler in an amount of between about 1 and 60 parts based on 100 parts polyvinyl halide.

15. The article of claim 1 wherein the coating comprises multiple layers.

16. The article of claim 15 wherein the coating comprises an outer layer of a tough, abrasion and wear resistant top coat, a skin layer beneath said top coat for providing snag resistance and color to the coated fabric article, a foam layer beneath said skin layer and an adhesive layer for adhering said coating to said fabric.

17. A flame retardant article comprising a flame retardant polyurethane foam which is covered by the coated fabric article of claim 1.

18. The article of claim 17 wherein the foam is an melamine modified polyurethane foam.

19. The article of claim 17 wherein the foam is a high resiliency or conventional polyurethane foam in conformance with the requirements of the State of California Technical Bulletin 117.

20. The article of claim 17 which when subjected 5 to the City of Boston Full Scale Chain Burn Test IX-2 will exhibit a flame out time of less than 8 minutes and weight loss of less than 10% with no dripping of foam, no excessive generation of smoke, and substantially no flame penetration through the article.

21. A coated fabric article comprising:

a single layer of fabric containing between about 30 and 50 weight percent of glass fiber and between 70 and 50 weight percent of a natural or synthetic fiber other than glass wherein the glass fibers form the core of a yarn and wherein the natural or synthetic fibers form a staple fiber sheath around the core and wherein the yarn is blended into a knit construction; said fabric having a weight of between about 1.5 and 5.5 ounces per square yard; and a coating substantially completely covering one side of said fabric, said coating comprising a fire-retardant thermoplastic polyvinyl halide composition of a polyvinyl halide, a plasticizer, and a flame retardant agent, wherein the plasticizer is present in an amount of between about 30 and 120 parts, and the flame retardant agent is present in an amount of between about 1 and 60 parts, each of said parts being based upon b 100 parts polyvinyl halide in the composition; said coating present in a thickness of between about 10 and 40 mils to impart the desired drapability, tailorability and physical properties to the coated fabric; such that, when said coated fabric is placed under tension forces and exposed to fire, said glass fiber provides a structure which provides strength to said article and which does not tear apart due to said tension forces when the coating burns, and further wherein said coating burns to form a char which adheres to said fabric, thus providing a barrier to the penetration of flame through the article.

22. The article of claim 21 wherein the natural or synthetic fibers include cotton, rayon, polyester, wool or nylon, and wherein the polyvinyl halide composition further comprises a flame retardant agent in an amount of between 1 and 50 parts, an additive for reducing smoke generation in an amount of between 1 and 30 parts, and a filler in an amount of between 1 and 60 parts.

23. A flame retardant article comprising:

a flame retardant polyurethane foam Which is surrounded by a coated fabric article comprising:

a single layer of fabric containing between about 30 and 50 weight percent of glass fiber and between 70 and 50 weight percent of a natural or synthetic fiber other than glass wherein the glass fibers form the core of a yarn and wherein the natural or synthetic fibers form a staple fiber sheath around the core and wherein the yarn is blended into a knit construction; said fabric having a weight of between about 1.5 and 5.5 ounces per square yard; and a coating substantially completely covering one side of said fabric, said coating comprising a fire-retardant thermoplastic polyvinyl halide composition of a polyvinyl halide, a plasticizer, and a flame retardant agent, wherein the plasticizer is present in an amount of between about 30 and 120 parts, and the flame retardant agent is present in an amount of between about 1 and 50 parts, each of said parts being based upon 100 parts polyvinyl halide in the composition; said coating present in a thickness of between about 10 and 60 mils to impart the desired drapability, tailorability and physical properties to the coated fabric; such that, when said coated fabric is placed under tension forces and exposed to fire, said glass article and which does not tear apart due to said tension forces when said coating burns, and further wherein said coating burns to form a char which adheres to said fabric, thus providing a barrier to the penetration of flame through the article.

24. The article of claim 23 wherein the foam is a high resiliency or conventional foam in conformance with the requirements of the State of California Technical Bulletin 117.

25. The article of claim 24 which when subjected to the City of Boston Full Scale Chain Burn Test IX-2 will exhibit a flame out time of less than 8 minutes and weight loss of less than 10% with no dripping of foam, no excessive generation of smoke, and substantially no flame penetration through the coating.

* * * * *